US006388374B1

(12) United States Patent
Vollkommer et al.

(10) Patent No.: US 6,388,374 B1
(45) Date of Patent: May 14, 2002

(54) SIGNAL LAMP HAVING A FLAT REFLECTOR LAMP WITH LOCALLY MODULATED LUMINANCE

(75) Inventors: Frank Vollkommer, Buchendorf; Lothar Hitzschke, Munich, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/355,357

(22) PCT Filed: Dec. 11, 1998

(86) PCT No.: PCT/EP98/08103

§ 371 Date: Jul. 28, 1999

§ 102(e) Date: Jul. 28, 1999

(87) PCT Pub. No.: WO99/34409

PCT Pub. Date: Jul. 8, 1999

(30) Foreign Application Priority Data

Dec. 12, 1997 (EP) ..... 97122799

(51) Int. Cl.[7] ..... H01J 1/62; H01J 63/04; H01J 17/49

(52) U.S. Cl. ..... 313/491; 313/582; 313/495; 313/483; 313/484

(58) Field of Search ..... 362/23, 29, 263; 313/572, 574, 582, 491, 493, 485, 495, 583, 484

(56) References Cited

FOREIGN PATENT DOCUMENTS

| | | |
|---|---|---|
| DE | 4311197 | 10/1994 |
| DE | 19526211 | 1/1997 |
| DE | 19636965 | 3/1998 |
| EP | 0932185 | 7/1999 |
| WO | 9109414 | 6/1991 |

*Primary Examiner*—Ashok Patel
*Assistant Examiner*—Mariceli Santiago
(74) *Attorney, Agent, or Firm*—William E. Meyer

(57) ABSTRACT

Flat radiator with dielectrically impeded discharge with an areally inhomogeneous electrode geometry for local modulation of the surface luminance, primarily for application in the field of indicating devices, for instance in motorized means of transport.

20 Claims, 1 Drawing Sheet

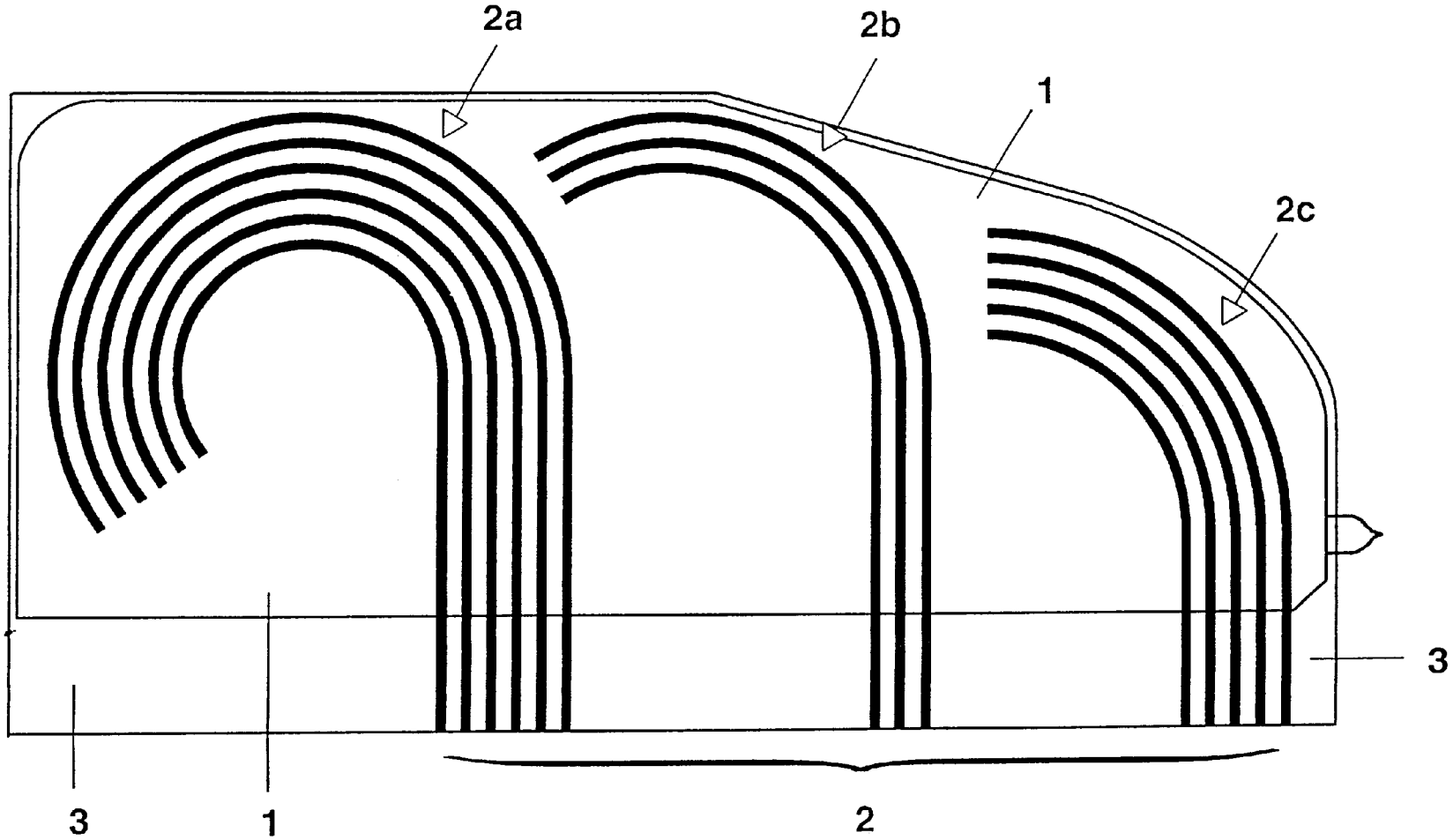
2c
2b
2a
1
3
2
1
3

SIGNAL LAMP HAVING A FLAT REFLECTOR LAMP WITH LOCALLY MODULATED LUMINANCE

CROSS-REFERENCE

Reference is made to the following parallel application applied for by the same applicant, having the application date Dec. 23, 1997: European patent application No. 97122800.2 entitled "Signallampe und Leuchtstoffe dazu" [Signal lamp and luminescent materials therefor].

TECHNICAL FIELD

The invention relates to lamps. There are different types of lamps and they can be distinguished according to the criteria of functional principle, structural size, design, power range, etc.

One of many aspects encountered in the development and selection of types of lamps for specific applications is the areal nature of the light generation and the uniformity of the areal light generation. Many applications involve, to mention a few examples, backlighting an area having a specific extent, distributing a specific light output over a specific area in order to reduce the glare effect, finding an illumination solution with a light output which is distributed as areally as possible for reasons of reducing the formation of shadows, designing a lamp with a particularly large area for decorative or structural reasons, and more besides. Examples of specific configurations are—backlit with meandering gas discharge lamps—advertising boards or signal lamps or mirror reflectors with incandescent lamps arranged near the focal point for the abovementioned aspect of areal backlighting and illumination, combinations of one or more geometrically large fluorescent lamps with (multiple) reflector systems for office lighting as an example of the aspect of freedom from glare and a low degree of shadow formation, or light tables for working with photographic negatives for the aspect of freedom from glare, and also pillar-shaped luminaires with upright fluorescent lamps, or frosted-diffusing glass panes backlit by a multiplicity of incandescent lamps for the sector of interior design and decoration.

PRIOR ART

Fluorescent lamps or gas discharge lamps have been used in many of such cases. Incandescent lamps, e.g. with reflector systems or systems comprising a multiplicity of incandescent lamps have also been used.

Fluorescent lamps with a dielectrically impeded discharge are a relatively recent type of lamp; they are frequently designed as flat radiators on account of their particular method of operation. In this case, a discharge volume is formed from plates, for instance made of glass, which are not necessarily planar in the sense of straight but are areal and largely planar, the electrode structures being produced on one or both glass plates. As a result of the electrode distribution over a large-area and possibly as a result of the use of additional diffusor layers, it is possible to realise large-area flat lamps with very uniform light distribution.

SUMMARY OF THE INVENTION

On the basis of the prior art that has been explained, the problem which underlies this invention is that of providing a lamp for fields of application with generation of light distributed over an area, which lamp adds new possibilities to the prior art in respect of the technical functionality or the aesthetic effect.

This problem is solved according to the invention by means of a flat radiator with dielectrically impeded discharge with an areally inhomogeneous electrode geometry for the local modulation of the surface luminance.

With this solution, the invention utilizes the particular structure of flat radiators for dielectrically impeded discharges in that it deliberately distributes, in a non-homogeneous manner, the geometrical distribution of the discharge electrodes on the flat walls of the discharge volume, that is to say e.g. on two essentially planar glass plates which enclose the discharge volume together with a frame. As a result, the invention departs from the principle that generally prevails in the prior art in the context of flat lamps or flat panels to be backlit and the like, namely the principle that the most uniform surface luminance possible is striven for.

This orientation of the invention which differs from the prior art is based on the insight that there are many applications in which local modulation—coordinated with the application—of the surface luminance by virtue of a corresponding inhomogeneous distribution of the electrodes in the area of the flat radiator may be advantageous. Such advantages may constitute better readability of a display or of a logo or signal, saving energy by virtue of better orientation of the surface luminance to the local illumination requirements, decorative effects that can be attained by virtue of the invention, and more besides. A number of examples are given in this application, and one is explained more specifically as an exemplary embodiment; however, the invention generally relates to lamps and to luminaires with lamps according to the invention.

In connection with the invention, a further measure leading to a preferred refinement of a flat radiator according to the invention may be very advantageous. In the case of this variant, the electrodes which are distributed areally inhomogeneously in accordance with the invention are operated in two or more groups which can be switched and/or operated independently of one another. For this purpose, the electrodes of a respective group are connected to a dedicated group-specific cathode or anode terminal. This is only possible in the first place as a result of the use of dielectrically impeded discharges, which—on account of their so-called positive current-voltage characteristic make it possible to connect a plurality of partial discharges or electrode paths in parallel to form electrode groups without difficulty.

In this case, it may be particularly expedient, precisely in connection with the locally inhomogeneous distribution of the electrodes on the flat radiator area, to have the separately operable groups respectively correspond to specific area regions of the flat radiator, in particular area regions of increased luminance, which can then be switched on and off separately from one another. The separately operable groups can alternatively be used for the power grading of the lamp or for producing different area patterns in order to attain particular optical effects.

Optical indicators constitute an essential exemplary embodiment of this invention. These may involve analogue instruments, as represented in the exemplary embodiment, digital displays, panels with individual indicating panels that set off symbolized messages determined by their luminosity, as in the case of conventional warning lamps, etc. A specific area form to be illuminated is prescribed in each case for the indicating device, with which area form the electrode geometry is coordinated in accordance with the invention. Thus, a higher surface luminance, the highest surface luminance or surface luminance at all is generated in the region of the area forms to be illuminated. This makes it possible for the entire quantity of light generated and hence the power consumption to be optimized in an application-specific manner, without application-specific forms or complicated forms being necessary for the flat radiator in its entirety, that is to say its housing geometry and/or the discharge volume.

The coordination of the electrode geometry and hence the surface luminance with the specific design of the indicating device which is to be illuminated or backlit also affords, independently of energy saving aspects, a further degree of freedom with regard to ergonomics, that is to say the more distinct structuring or better discernability of the indicating device and its different representations and functions. This aspect is also evident in combination with the separate switch-ability of different groups, specifically in the sense that, for reasons of saving energy or ergonomics, different regions of the indicating device can be operated with different degrees of brightness and thus specific regions and messages of the indicator can be emphasized. It is also possible to mask out specific, instantaneously irrelevant regions of the indicating device by connecting them in the dark state, etc. These above aspects have been explained here for the indicating devices as a particular application because they appear to be of particular interest in that case. However, they may also play a part in entirely different fields of application of the invention and should also be regarded as having been disclosed therefor.

The exemplary embodiment of this invention which will be explained in more detail below relates to an indicating device in a motor vehicle "dashboard". This special case represents a preferred field of application of the invention, namely indicating devices in road or rail vehicles, ships or aircraft, or motorized means of transport in general. The ergonomic requirements made of indicating devices or fittings are particularly high especially in this field.

A special case for the field of indicating devices in respect of geometry is that of analogue indicators in which, as illustrated in the exemplary embodiment, primarily the following forms occur for backlighting by an adapted electrode geometry: circles, circle segments, annuli and annuli segments. With conventional technology, such forms can be backlit in a defined fashion virtually only by the use of screens or masks, with the result that the invention can offer significant advantages in this context with regard to the simplicity of the technical construction and the power consumption. That applies in particular to annuli or annuli segments and other high forms or forms curved about an inner region.

As already mentioned above, the invention must be understood as not being restricted to the field of signal lamps or indicating devices. To mention just one example of an application which lies entirely outside this field and in which the invention affords not just technical and ergonomical advantages, mention shall be made of indoor luminaires. Especially by virtue of the possibility of constructing large-area, flat luminaires for the interior sector with very low surface luminances compared with incandescent lamps, flat radiator technology with dielectrically impeded discharge appears to be of interest in this context as well. A particular decorative or aesthetic effect can be obtained in multiple respects as a result of the invention's local modulation of the surface luminance. For example, it is possible to imagine placing correspondingly adapted flat radiators behind graphically configured screens, so that specific elements in the screen are specifically emphasized by their brightness, for instance in the context of figurative representations for the childre's room.

On the other hand, it is also possible, by way of example, for a flat radiator luminaire mounted flat on the room wall to acquire a particularly attractive design by virtue of aesthetically pleasing structuring of the luminance distribution. This applies in particular in contrast with the fully homogeneous and closed outer form that can be obtained for such a luminaire due to the uniform discharge volume. Of course, different possibilities for using the group distribution—already outlined above—of the electrodes for the purpose of separately switchable operation are also afforded in this context with regard to power control or from structural standpoints.

DESCRIPTION OF THE DRAWINGS

The invention will now be illustrated using a specific exemplary embodiment represented schematically in the figure. The figure shows a plan view of a flat radiator for a motor vehicle "dashboard" for the backlighting of a combination instrument for indicating the speed, the engine speed, the temperature of the cooling water, and the tank content.

What is represented first of all is the outer edge of a discharge volume which is designated by 1 and is enclosed by two glass plates, lying flat in the plane of the drawing, and a seal running along the illustrated edge. In the lower region of the figure, the glass plates project beyond the discharge volume 1 with an attachment designated by 3. The pump connector used for evacuation and filling is illustrated (in the closed state) at the right-hand edge. The electrodes, which are printed onto one of the plates, are designated summarily by 2, with cathodes and anodes respectively running alternately but not being differentiated any more closely in the figure. The greatest part of the length of the electrodes 2 is situated in the discharge volume 1 and the said electrodes are connected to the supply circuit and motor vehicle electrical system at their part which is situated outside the discharge volume 1, in the region of the attachment 3.

The electrodes 2 are present in three spatially separate groups 2*a,* 2*b* and 2*c,* which respectively correspond to specific indicating units or contents. Specifically, the left-hand group 2*a* corresponds to an analogue instrument for indicating speed and, apart from its straight section leading to the attachment 3, tracks the annulus segment of this analogue instrument. The same applies correspondingly to the group 2*b,* which corresponds to an engine tachometer. Two instruments are amalgamated in the case of group 2*c,* to be precise an indicator of the tank content and a cooling water thermometer.

In the present case, this separation serves to enable just the information that is actually necessary for the driver to be displayed on the dashboard, depending on the operating state of the motor vehicle. That is always the speed indicator 2*a.* The indicator 2*b* is added in the event of the engine speed limit being reached or if the driver wishes it. In an analogous manner, the third unit 2*c* for backlighting the remaining two instruments can be activated in the event of an almost empty fuel tank or in the event that the temperature of the cooling water of the engine is still low or excessive, and also, of course, if the driver wishes it. Individual monitoring and warning panels in the indicating device represented are also switched on, as required, in a precisely analogous manner. The corresponding electrode structures in each case form further groups, but are not illustrated in the figure for the sake of clarity. The customary warning indications may be imagined, for instance "handbrake on", "high beam switched on", etc.

The electrodes 2 are printed onto one of the two glass plates by the screen printing method. They are coated with a glass barrier as dielectric. The distance between the two glass plates is approximately 7 mm, and they are joined by means of glass solder as a seal via a glass frame forming the outer edge of the discharge volume 1. The discharge volume which is tightly enclosed in this way contains a Xe filling at approximately 100 mbar (=10 kPa) as discharge filling.

Further details concerning the technology of Xe excimer discharge lamps and concerning the pulsed method of operation chosen here can be found in the following applications, whose disclosure contents are incorporated here by reference: WO 94/23 442 or DE-P 11 197.1 and WO 97/04625 or DE 195 26 211.5. Reference is furthermore made to the application DE 196 36 965.7, which shows particular electrode structures for defining the individual discharges burning between the cathodes and anodes in terms of their geometric structure. For this purpose, small projections are fitted on the cathodes in this exemplary embodiment, too. Reference is furthermore made to an application applied for by the same applicant and entitled: "Signallampe und Leuchtstoffe dazu" [Signal lamp and luminescent material therefor], file reference EP 97122800.2 which shows preferred luminescent materials for signal lamps, in particular for Xe excimer discharges. The disclosure of these two applications is also incorporated here by reference.

From the exemplary embodiment above, it becomes clear that the invention, in contrast to the conventional use of bent fluorescent lamps or a plurality of incandescent lamps, is distinguished by a technically simple structure that can be manufactured efficiently, and by a surface luminance distribution which is adapted precisely to the design of the indicating device. The utilization of energy and the ergonomics are thus improved. Furthermore, flat radiators with dielectrically impeded discharge are also particularly advantageous because they have a high switching endurance and insensitivity to vibration and, in terms of their service life, are limited in principle only by the stability of the luminescent materials used ("maintenance"). These advantages are important primarily in the case of motorized means of transport, in which the outlay for repair or for replacement is high and failure of an indicating device and/or its illumination is particularly unfavourable for safety reasons. The geometry of the flat radiators may also be advantageous, the said flat radiators, as is clear in this exemplary embodiment, being able to be adapted, in terms of form and size, particularly well to the location of use or installation. At the same time, the present invention nevertheless permits the use of simple flat-radiator housing forms, in the present example the external form of the discharge volume 1 including the attachment 3 instead of the complicated annulus segments with connection elements. The flatness is also advantageous given the limited space conditions in a dashboard, cockpit, etc. The same applies to the low weight.

The features of the invention which have been disclosed in this application, in particular in the exemplary embodiment, may also be essential to the invention individually or in combinations other than those represented.

What is claimed is:

1. A flat radiator with dielectrically impeded discharge with an areally inhomogeneous electrode geometry for local modulation of the surface luminance.

2. An indoor luminaire with a flat radiator according to claim 1.

3. An indicating device or signal lamp with a flat radiator according to claim 1 as an indicating device in a vehicle, ship or aircraft.

4. An indoor luminaire with a flat radiator according to claim 3.

5. The flat radiator according to claim 1 wherein the electrode geometry for the backlighting has circular, circle segment-shaped, annular or annulus segment-shaped analogue indicators.

6. An indoor luminaire with a flat radiator according to claim 5.

7. The flat radiator according to claim 1 with an optical indicating device or signal device and wherein the electrode geometry is coordinated with an area form—to be illuminated—of the indicating device or signal device.

8. The flat radiator according to claim 7, wherein each group for the backlighting has a circular, circle segment-shaped, annular or annulus segment-shaped analogue indicators.

9. An indoor luminaire with a flat radiator according to claim 7.

10. The flat radiator according to claim 1, in which the electrodes are divided into separately operable groups for the purpose of independently switchable operation.

11. An indoor luminaire with a flat radiator according to claim 10.

12. The flat radiator according to claim 10, wherein each group for the backlighting has a circular, circle segment-shaped, annular or annulus segment-shaped analogue indicators.

13. The flat radiator according to claim 10, with an optical indicating device or signal device and wherein the electrode geometry is coordinated with an area form—to be illuminated—of the indicating device or signal device.

14. An indoor luminaire with a flat radiator according to claim 13.

15. The flat radiator according to claim 13, wherein each group for the backlighting has a circular, circle segment-shaped, annular or annulus segment-shaped analogue indicators.

16. The flat radiator according to claim 10, in which the groups are divided areally and correspond to different luminous areas which can be operated independently.

17. The flat radiator according to claim 16, with an optical indicating device or signal device and wherein each group is coordinated with an area form—to be illuminated—of the indicating device or signal device.

18. The flat radiator according to claim 17, wherein each group for the backlighting has a circular, circle segment-shaped, annular or annulus segment-shaped analogue indicators.

19. The flat radiator according to claim 16, wherein each group for the backlighting has a circular, circle segment-shaped, annular or annulus segment-shaped analogue indicators.

20. An indoor luminaire with a flat radiator according to claim 16.

* * * * *